US009877625B2

(12) United States Patent
Venard et al.

(10) Patent No.: US 9,877,625 B2
(45) Date of Patent: Jan. 30, 2018

(54) FLOOR CLEANING TOOL HAVING A MECHANICALLY OPERATED PUMP

(71) Applicant: Karcher North America, Inc., Englewood, CO (US)

(72) Inventors: Daniel C. Venard, Centennial, CO (US); Adam Bearup, Lakewood, CO (US)

(73) Assignee: Kärcher North America, Inc., Denver, CO (US)

( * ) Notice: Subject to any disclaimer, the term of this patent is extended or adjusted under 35 U.S.C. 154(b) by 587 days.

(21) Appl. No.: 14/592,426

(22) Filed: Jan. 8, 2015

(65) Prior Publication Data

US 2015/0121648 A1 May 7, 2015

Related U.S. Application Data

(63) Continuation-in-part of application No. 13/961,673, filed on Aug. 7, 2013, now Pat. No. 9,301,661.

(60) Provisional application No. 61/680,635, filed on Aug. 7, 2012, provisional application No. 61/752,230, filed on Jan. 14, 2013.

(51) Int. Cl.

| | |
|---|---|
| ***A47L 11/30*** | (2006.01) |
| ***A47L 5/08*** | (2006.01) |
| ***A47L 7/00*** | (2006.01) |
| ***A47L 9/32*** | (2006.01) |
| ***A47L 11/40*** | (2006.01) |
| ***A47L 13/20*** | (2006.01) |
| ***A47L 13/58*** | (2006.01) |
| ***A47L 9/00*** | (2006.01) |

(52) U.S. Cl.

CPC ..... *A47L 5/08* (2013.01); *A47L 7/0004* (2013.01); *A47L 7/0009* (2013.01); *A47L 7/0019* (2013.01); *A47L 9/009* (2013.01); *A47L 9/325* (2013.01); *A47L 11/4044* (2013.01); *A47L 11/4072* (2013.01); *A47L 11/4088* (2013.01); *A47L 13/20* (2013.01); *A47L 13/58* (2013.01)

(58) Field of Classification Search

CPC ..... A47L 7/0004; A47L 7/0009; A47L 9/009; A47L 7/019; A47L 11/4088; A47L 11/4044; A47L 13/20; A47L 11/30

USPC ..... 15/320, 403

See application file for complete search history.

(56) References Cited

U.S. PATENT DOCUMENTS

| | | | |
|---|---|---|---|
| 1,022,499 | A | 4/1912 | Osterholm |
| 1,037,027 | A | 8/1912 | Lindberg |

(Continued)

FOREIGN PATENT DOCUMENTS

| | | |
|---|---|---|
| CA | 2242793 | 5/1999 |
| CA | 2283539 | 3/2000 |

(Continued)

OTHER PUBLICATIONS

Extended Search Report for European Patent Application No. 13827475.8, dated Aug. 21, 2015 7 pages.

(Continued)

*Primary Examiner* — David Redding

(74) *Attorney, Agent, or Firm* — Sheridan Ross P.C.

(57) ABSTRACT

A compact machine for cleaning floors includes a solution tank and dispensing system for dispensing solution onto the surface to be cleaned, a deck assembly for guiding dirty solution to a recovery pickup point, a mechanically operated pump for collecting the dirty solution from the recovery pickup point, and a recovery tank for receiving the collected fluid.

18 Claims, 6 Drawing Sheets

(56) References Cited

U.S. PATENT DOCUMENTS

| | | | |
|---|---|---|---|
| 1,091,383 | A | 3/1914 | Oblosser |
| 1,243,516 | A | 10/1917 | Harris |
| 1,327,456 | A | 1/1920 | Baender |
| 1,377,721 | A | 5/1921 | Owen et al. |
| 1,384,999 | A | 7/1921 | Graham |
| 1,605,857 | A | 11/1926 | Sherbondy |
| 2,910,721 | A | 11/1959 | Burrage |
| 4,363,152 | A | 12/1982 | Karpanty |
| 4,369,544 | A | 1/1983 | Parisi |
| 4,619,010 | A | 10/1986 | Burgoon |
| 5,613,270 | A | 3/1997 | Alvarez et al. |
| 5,768,742 | A | 6/1998 | Kohl et al. |
| 6,206,980 | B1 | 3/2001 | Robinson |
| 6,283,170 | B1 | 9/2001 | Robinson |
| 6,431,217 | B2 | 8/2002 | Robinson |
| 6,530,117 | B2 | 3/2003 | Peterson |
| 6,647,585 | B1 | 11/2003 | Robinson |
| 6,766,556 | B2 | 7/2004 | Gergek |
| 6,789,552 | B1 | 9/2004 | Robinson et al. |
| 7,137,170 | B1 | 11/2006 | Morey et al. |
| 7,270,251 | B1 | 9/2007 | Robinson |
| 7,272,869 | B1 | 9/2007 | Robinson |
| 7,316,049 | B1 | 1/2008 | Robinson, Sr. et al. |
| 7,490,745 | B1 | 2/2009 | Robinson |
| 7,640,622 | B2 | 1/2010 | Vankouwenberg |
| 7,717,354 | B1 | 5/2010 | Robinson |
| 7,878,378 | B1 | 2/2011 | Robinson |
| 2003/0005546 | A1 | 1/2003 | Bone |
| 2004/0244133 | A1 | 12/2004 | Li |
| 2006/0254020 | A1 | 11/2006 | Robinson |
| 2007/0267044 | A1 | 11/2007 | Robinson |
| 2010/0293740 | A1 | 11/2010 | Gordon et al. |
| 2014/0041146 | A1 | 2/2014 | Venard et al. |
| 2015/0040945 | A1 | 2/2015 | Venard et al. |

FOREIGN PATENT DOCUMENTS

| | | |
|---|---|---|
| CN | 2043101 | 8/1989 |
| CN | 1209984 | 3/1999 |
| CN | 201067376 | 6/2008 |
| EP | 2125250 | 11/2011 |
| GB | 16679 | 0/1911 |
| GB | 643817 | 9/1950 |
| KR | 20100130293 | 12/2010 |

OTHER PUBLICATIONS

Notice of Allowance with English Translation for Korea Patent Application No. 30-2015-0009020, dated Sep. 17, 2015 3 pages.

Notice of Allowance for U.S. Appl. No. 13/961,673, dated Sep. 30, 2015 5 pages.

"3M Easy Trap Duster 5"×125 ft," Item #MCO55655, Jan. 16, 2013, available at https://web.archive.org/web/20130116145835/http://www.ibuyofficesupply.com/easy-trap-duster-5-x-125-ft_MCO55655, 2 pages.

"Semi-Auto Scrubbers Owners Manual FANG18C," Viper North America, 2012, 18 pages.

English Translation of Official Action for China Patent Application No. 201380014988.0, dated Dec. 4, 2015 8 pages.

English Translation of Official Action for China Patent Application No. 201380014988.0, dated Jul. 28, 2016 5 pages.

International Search Report and Written Opinion for International (PCT) Patent Application No. PCT/US2015/048451, dated Dec. 4, 2015 10 pages.

U.S. Appl. No. 29/500,066, filed Aug. 21, 2014, Venard et al.

U.S. Appl. No. 14/592,423, filed Jan. 8, 2015, Venard et al.

International Search Report and Written Opinion for International (PCT) Patent Application No. PCT/US2013/053998, dated Feb. 7, 2014 8 pages.

Official Action for U.S. Appl. No. 13/961,673, dated Jan. 9, 2015, 16 pages.

International Preliminary Report on Patentability for International (PCT) Patent Application No. PCT/US2013/053998, dated Feb. 19, 2015 8 pages.

Notification of Grant (with English Translation) for Chinese Patent Application No. 201530047919.1, dated Jul. 22, 2015, 5 pages.

Official Action (with English translation) for Korean Patent Application No. 30-2015-0009020, dated Jul. 2, 2015, 4 pages.

Final Action for U.S. Appl. No. 13/961,673, dated Jun. 25, 2015, 12 pages.

FLOOR CLEANING TOOL HAVING A MECHANICALLY OPERATED PUMP

This U.S. Non-Provisional patent application is Continuation of and claims the benefit of priority to U.S. patent application Ser. No. 13/961,673, filed Aug. 7, 2013, which claims the benefit of priority from U.S. Provisional Patent Application Ser. No. 61/680,635, filed Aug. 7, 2012, and U.S. Provisional Patent Application Ser. No. 61/752,230, filed Jan. 14, 2013, the entire disclosures of which are hereby incorporated by reference in their entireties.

FIELD

The present disclosure is directed to floor cleaning tools having a mechanically operated pump. Tools of the present invention are capable of performing floor or surface cleaning functions, including dispensing and recovering liquid from the floor or surface.

BACKGROUND

Conventional tools for cleaning floors range from a mop and bucket to pressure washers to automatic scrubbers. With the mop and bucket, solution is added to the bucket and then a mop made out of absorbent material is used to suck up the solution and then apply it to the floor. The mop is then used as the abrasive tool to break dirt loose from the floor. The dirt from the floor collects in the mop which is then submersed in the solution in the bucket. Dirt is rinsed from the mop by repeated dunking and wringing (usually with a mop wringer).

This process is sub-optimal for a number of reasons. First, dirt from the floor is returned to the bucket causing the solution to become dirtier and dirtier such that an area cleaned towards the end of the process is never as clean as the first area cleaned. Some mop buckets exist today that have a solution tank and a rinse tank which helps to keep the solution clean for a longer period of time, but dirt is still carried into the solution tank by the mop.

Secondly, absorbent mops required to lift solution out of the bucket and onto the floor do not make very good scrubbers. Ideally, an abrasive pad or bristle brush is used to break dirt free, but they do not absorb water and cannot be used to get the water from the bucket to the floor or dirty water from the floor back to the bucket. Sponge and abrasive pad combinations that accomplish both tasks are common for cleaning in a domestic setting, but are rarely used in commercial environments since floor coverage is too great and capacity to hold dirt is insufficient.

Pressure washers utilizing high-pressure pumps rely on the high-pressure discharge of cleaning solution as a means to break dirt free. Pressure washers are available with vacuum capability to recover the solution and the dirt as it is sprayed. These systems use a significant amount of water and are expensive and more difficult to use and maintain than the floor cleaning tool of the present invention.

With automatic scrubbers, solution is dispensed to the floor, scrub pads or brushes driven by motors break the dirt free, and a vacuum and squeegee return the dirty solution to a separate tank leaving the solution clean from start to finish. However, like pressure washers, automatic scrubbers are significantly more expensive and more difficult to operate and maintain. Additionally, automatic scrubbers are hard to maneuver in tight places and are incapable of cleaning under low profile objects (shelves, tables, chairs, etc.). Some automatic scrubbers have wand accessories with or without powered brushes for reaching in these tight spots, but these generally suffer from sub-optimal performance as automatic scrubbers are designed to clean large, unobstructed areas.

Both pressure washers and automatic scrubbers typically include electrically powered pumps or vacuums for dispensing water and/or cleaning solution and for collecting dirty water and/or cleaning solution. Such electrically operated pumps and vacuums increase the cost of these machines. Further, these machines require an electrical power source, which increases the machines' operating cost while limiting the machines' field of use (i.e. near a electrical outlet) or duration of use (i.e. until the battery is fully discharged).

SUMMARY

The present invention is a vast improvement over the mop and bucket, yet is much less expensive than the pressure washer and automatic scrubber. It is also easier to use and maintain. Embodiments of the present disclosure comprise: (1) a solution tank and a gravity-fed dispensing system to apply a solution to a surface, (2) a deck assembly having an abrasive pad or brush for scrubbing the surface being cleaned and a squeegee for collecting used cleaning solution, and (3) a mechanically operated pump that produces suction in a fluid communication path that terminates near the squeegee to convey the dirty solution into a recovery tank. Because neither the dispensing system nor the pump requires electrical power, devices of the present disclosure are simple, highly portable, cost effective, and easy to use and maintain. Additional features include dispensation of solution, keeping clean and dirty solutions separate, and collecting the dirty solution. Variations on these and other aspects of the present disclosure are described below.

In one embodiment, a portable, human-powered floor cleaning device is provided, the device comprising a chassis comprising: a clean fluid storage tank and a spent fluid collection tank; a plurality of wheels for supporting and moving the device; a deck assembly comprising a fluid pick-up orifice and a squeegee; a mechanically-driven pump housed within the chassis having an inlet and an outlet, the pump operably interconnected to a drive wheel such that a rotational movement of the drive wheel results in actuation of the pump; the fluid pick-up orifice being interconnected to the pump by a conduit for transmitting fluid from the fluid pick-up orifice to the pump; wherein conduit comprises at least one valve for substantially preventing flow of a fluid in a first direction; wherein the device is devoid of power generation unit, such that translation of the device and actuation of the pump are driven by a user imparting force to the device.

In one embodiments, a motorless floor washing machine is provided, the machine comprising: a chassis comprising a clean fluid storage tank and a spent fluid collection tank; at least two wheels for supporting and moving the machine; a trailing deck assembly comprising a fluid pick-up orifice and a squeegee; a mechanically-driven pump housed within the chassis having an inlet and an outlet, the pump operably interconnected to a drive wheel via a shaft such that a rotational movement of the drive wheel results in substantially vertical displacement of the shaft to provide power to the pump; the fluid pick-up orifice being interconnected to the pump by a conduit for transmitting fluid from the fluid pick-up orifice to the pump; wherein the pump is positioned above the pick-up orifice and the conduit comprises at least one valve substantially preventing flow of a fluid in a direction away from the pump.

In one embodiment, a floor cleaning tool for cleaning a surface is provided, the floor cleaning tool comprising a chassis comprising: a first tank for containing a cleaning solution, the first tank having a discharge port positioned to effect dispensing of the cleaning liquid therefrom; a second tank for receiving the cleaning solution following its being dispensed to the surface; and a mechanically-driven pump for removing the cleaning solution from the surface and discharging the collected cleaning solution into the second tank; a conduit for transmitting the cleaning solution from a collection point to the second tank, the conduit comprising at least one non-return valve for substantially preventing flow of the fluid away from the second tank. A rotatable trailing deck assembly is provided connected to the chassis and comprising a squeegee, the deck assembly being selectively detachable from the chassis. A main wheel assembly is provided comprising at least two wheels for supporting and moving the chassis, at least one of the wheels comprising a drive wheel with a rotational motion mechanism for converting the rotational motion of the drive wheel into reciprocal motion, and the drive wheel provided substantially directly beneath the pump and operably connected to the pump by a substantially vertical drive shaft.

It is an object of the present disclosure to describe an efficient and yet economical scrubber which can be manually operated. Other objects and advantages of the present disclosure will become apparent to those skilled in the art upon a review of the following detailed description of the preferred embodiments and the accompanying drawings.

According to varying embodiments of the present disclosure, a floor cleaning tool having a mechanically operated pump is disclosed.

BRIEF DESCRIPTION OF THE DRAWINGS

The accompanying drawings, which are incorporated in and constitute part of the specification, illustrate embodiments of the present disclosure and together with the general description given above and the detailed description of the drawings given below, serve to explain the principle of the present disclosure.

Figure 1:
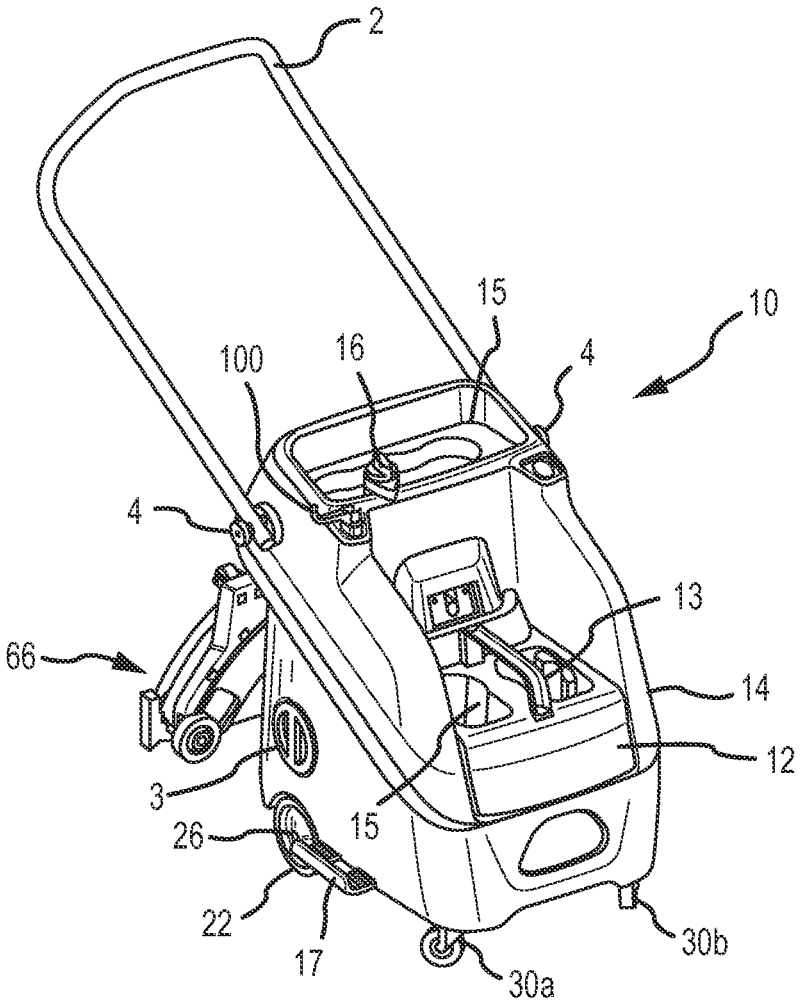
FIG. 1 is a perspective view of an embodiment of a floor cleaning tool according to the present disclosure.

It should be understood that the drawings are not necessarily to scale. In certain instances, details that are not necessary for an understanding of the disclosure or that render other details difficult to perceive may have been omitted from these drawings. It should be understood, of course, that the present disclosure is not limited to the particular embodiments illustrated in the drawings.

DETAILED DESCRIPTION

Varying embodiments of the present disclosure are described herein with reference to the drawings. It is expressly understood that although FIGS. 1-6 depict certain embodiments of a floor cleaning tool, the present disclosure is not limited to those specific disclosed embodiments.

Figure 2:
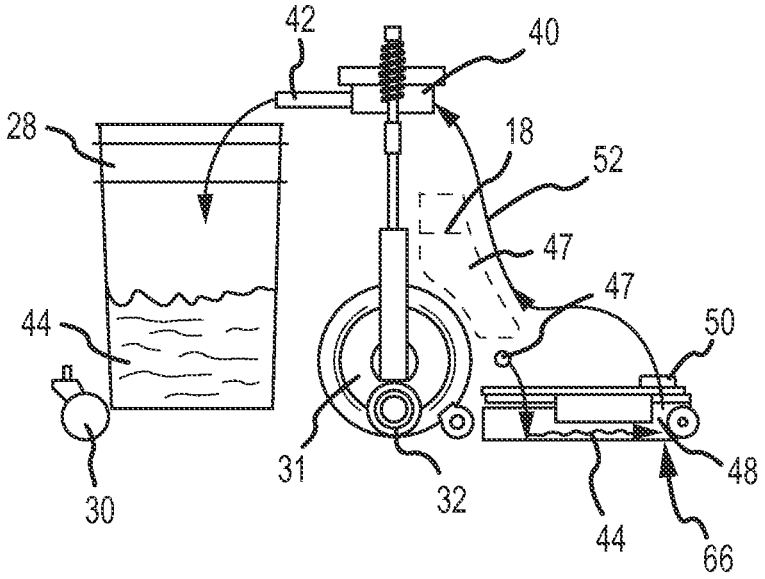
FIG. 2 is a partial schematic view of an embodiment of a floor cleaning tool according to the present disclosure.

Referring to FIGS. 1-2, there is provided a floor cleaning tool 10 having a chassis 14 with main wheels 22 mounted on an axle 26 proximal a rearward portion of the tool 10. The chassis 14 comprises a deck 66 comprising cleaning and fluid collection features as will be shown and described in more detail herein. In some embodiments, the chassis 14 is rotationally molded from one of a variety of plastic materials such as high density polyethylene. The chassis 14 is provided with a cleaning solution tank which extends from the back of the chassis 14 adjacent the main wheels 22 to the front of the chassis 14, and occupies the majority or all of the lower portion of the chassis 14. The cleaning solution tank holds cleaning solution 18, which may be any liquid useful for cleaning, including water, soap, and/or cleaning chemicals. In various embodiments of the present disclosure, the position, size, and shape of cleaning solution tank 18 can be modified as desired and/or convenient; neither the parameters nor the location of the cleaning solution tank 18 is critical to the present disclosure.

FIG. 2 is a side view of a fluid application and recovery system according to one embodiment of the present invention, and shown in isolation with respect to certain additional features of the present disclosure. As shown, a recovery pump 40 is provided for translating fluids. The recovery pump 40 comprises a mechanical pump driven by ground-induced rotational movement of a drive wheel 31. Additional wheels 30, 32 are provided for supporting the device and/or providing rotational power to the drive wheel 31 and associated pump 40. Accordingly, movement of the device along a surface provides the power required to drive a pump 40 and draw fluid from a ground or floor surface. The pressure differential created by the pump 40 draws a fluid from the floor via recovery line 52 which is operatively associated with a pick-up orifice 48 located proximal to the floor. Clean fluid 47 dispensed from the device 10 contacts and cleans the floor as it is converted to dirty fluid 44 and subsequently transported or picked up by the pump 40 and conveyed to a recovery tank 28 or similar receptacle.

In various embodiments, one or more conduits between a pick-up orifice 48 and a recovery tank 28 are provided with means for maintaining sufficient pressure and preventing back-flow in the conduit(s). For example, in certain embodiments, one or more check valves 42, 50 are provided for reducing or eliminating the risk of back-flow or pressure loss in the line 52. Check valves preferably comprise valve features permitting only unidirectional flow of the fluid 44 (i.e. from the floor/orifice 48 to the recovery tank 44). It will be recognized that where pump pressure is lost or where fluid is allowed to drain downwardly in line 52, such as by the force of gravity, pump 40 may become ineffective at removing fluid 44 as intended. It is also an object of the present invention to prevent fluid disposed between inlet 48 and pump 40 to simply drain out of the device when the tool is brought to rest. Accordingly, the present invention contemplates providing at least one valve feature for reducing or eliminating this risk. As shown, a first valve 50 is provided proximal the inlet orifice 48. A second valve 42 is provided proximal to and downstream of the pump 40. In various embodiments, valves 42, 50 comprise valves that allow for fluid flow in one direction (i.e. toward the reservoir 28), and substantially prevent back flow or fluid flow in a reverse direction. Such valves may comprise check valves, non-return valves, clapper valves, one-way valves or various other valve types that provide the described function(s).

Figure 3:
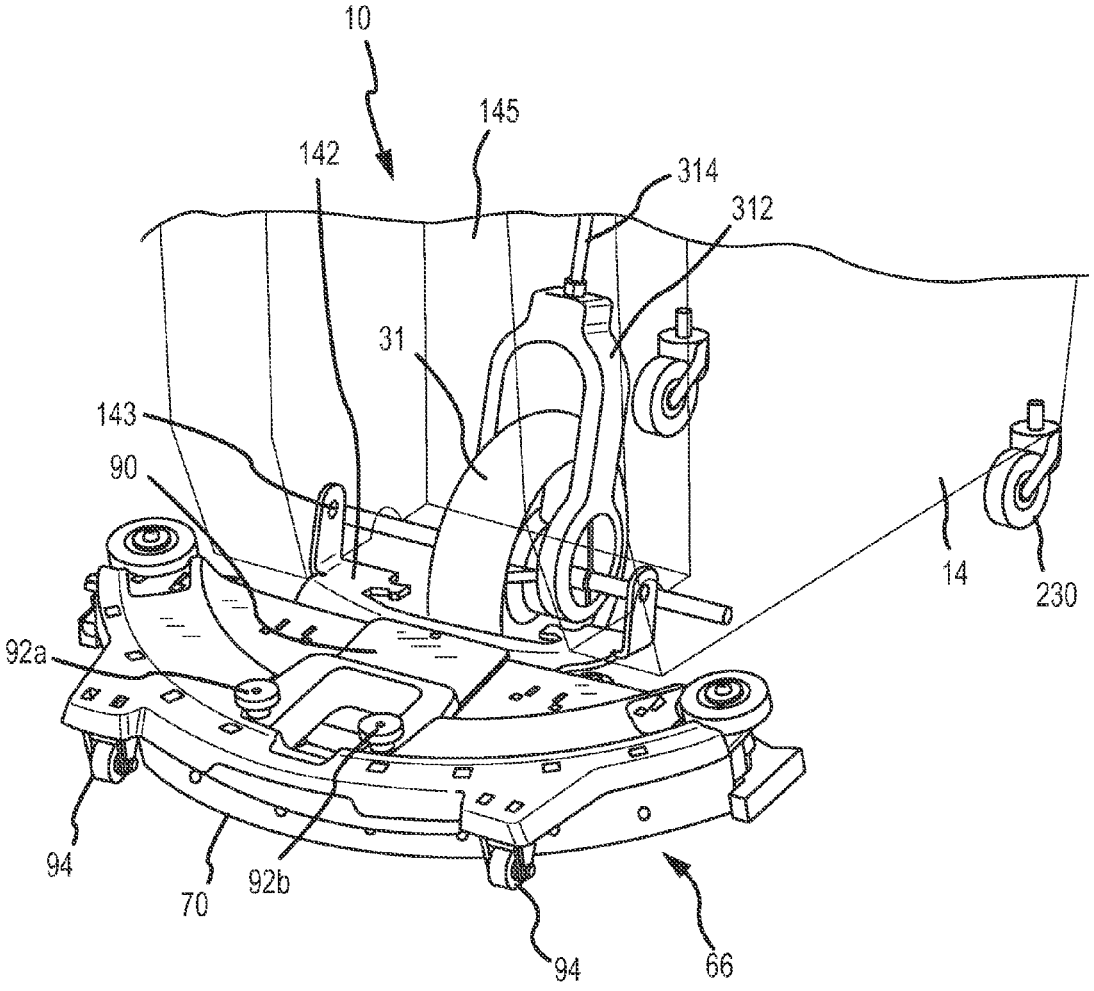
FIG. 3 is a detailed perspective view of an embodiment of a floor cleaning tool according to the present disclosure.

As shown in FIGS. 2-3, cleaning fluid is dispensed via clean fluid conduit 47 preferrably directly in front of a squeegee and within an area defined by the deck assembly 66. Dispensation of fluid through the clean fluid conduit 47 is controlled or metered by one or more control means 16 provided on or proximal the chassis 14. As will be recognized by one of skill in the art, devices 10 of the present invention are useful for cleaning up spills and liquids from external or pre-existing sources. Additionally, however, devices 10 of the present invention comprise the ability to dispense cleaning fluid(s) to a surface, perform cleaning functions (e.g. scrubbing, wiping, etc.), and collect and store such fluids after they have performed their intended function. Accordingly, the present invention comprises a multi-purpose floor cleaning device.

Referring now to FIG. 1, the cleaning device 10 comprises various features for assisting in various cleaning tasks. For example, the depicted embodiment of the cleaning device 10 is provided with a storage unit 12. Storage unit 12 comprises a selectively removable device provided with a handle 13 and one more storage areas 15 for containing various products, including but not limited to, cleaning products, tools, waste products, etc. In certain embodiments, the storage unit 12 is provided as a replacement to and in lieu of a spent fluid collection tank. For example, and as shown in FIG. 1, the device 10 may be provided in a state wherein the pump and the deck 66 are inactive, and the device 10 is essentially a caddy or cart. The deck 66 is shown in an elevated position in FIG. 1, wherein it has been rotated upward and out of contact with the floor or ground surface upon which the device 10 rests. A user-operated control 16 is provided on an exterior of the chassis 14 such that dispensation of cleaning fluid can be selectively controlled. The control 16 is contemplated as being any one or more of known devices useful for starting, stopping, and/or metering flow of a fluid. The control 16 may, for example, control a ball valve for initiating and terminating fluid to be dispensed. The device 10 further comprises attachment features, such as a shelf portion 17 for receiving and supporting a mop, broom, or similar cleaning device.

A port 3 is provided on a portion of the chassis 14. The port 3 may serve as a drain or input for fluid for one or both of the clean fluid storage tank and the spent fluid storage tank. In one embodiment, the port 3 comprises a simple drain for removing unused clean fluid from the clean fluid storage tank, such as may be desirable when the device 10 is to be stored or transported and emptying of the device 10 is preferred.

As shown in FIG. 1, a user interface portion 2 comprises a simply handle for grasping and maneuvering the device 10. The interface portion 2 is rotatable and detachable at the locating of fasteners 4. Fasteners 4 comprise, for example, simple threaded fasteners.

Figure 5:
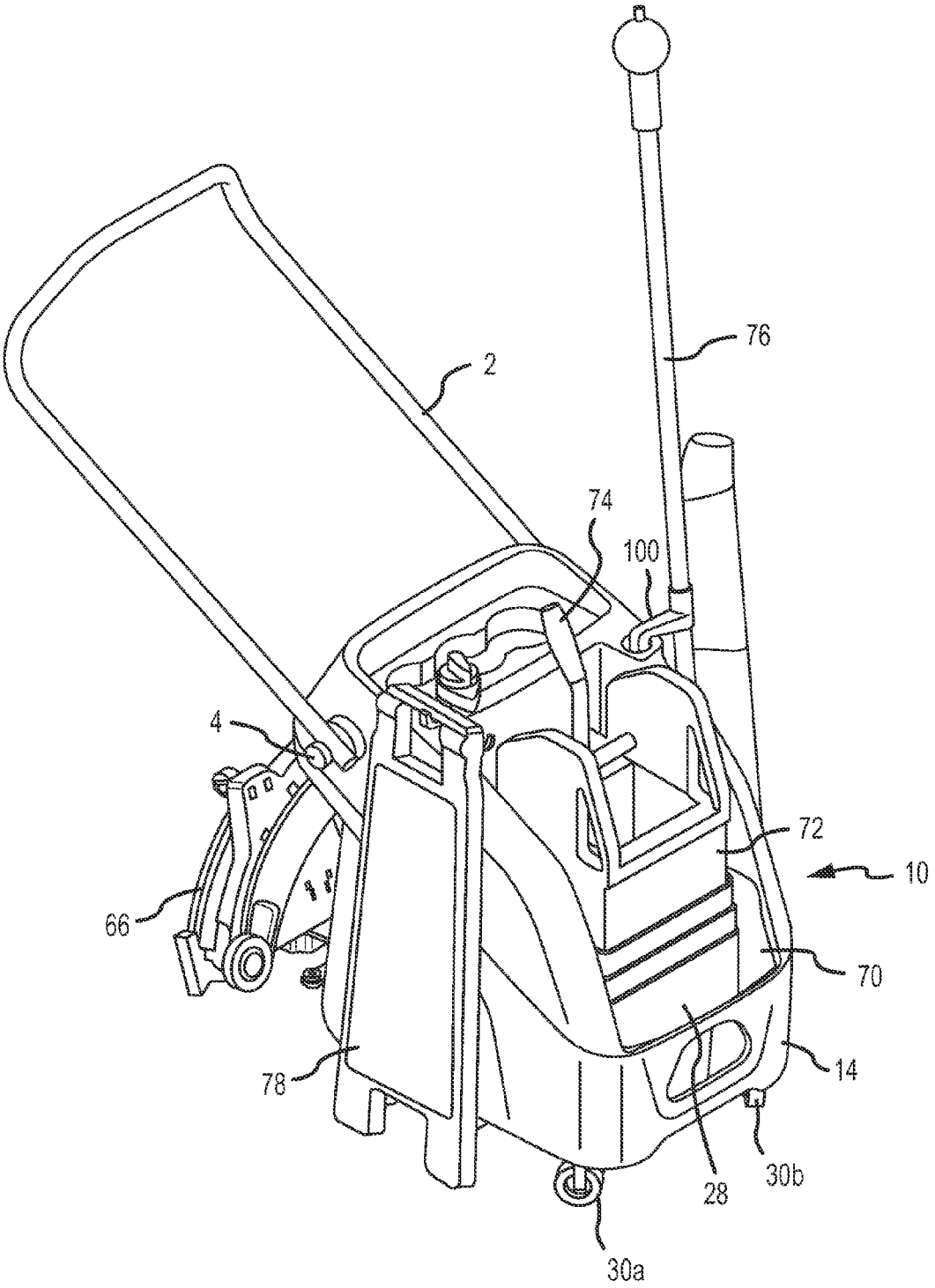
FIG. 5 is phantom perspective view of an embodiment of a floor cleaning tool according to the present disclosure.

Referring to FIGS. 2 and 5, the chassis 14 further comprises a recovery tank 46. Preferably, recovery tank 28 is removably mounted on chassis 14 and is equipped with a handle to facilitate removal of the recovery tank 28 from the chassis 14, i.e. when disposing of the contents of recovery tank 28. The recovery tank 28 rests on top of solution tank 18. The upper portion of recovery tank 28 has an inlet opening (not shown) through which dirty cleaning solution is pumped into recovery tank 28 during operation of floor cleaning tool 10.

To further simplify attachment and detachment of deck assembly 66 to and from trailing arm 142, large, easily manipulated squeegee mount knobs 92*a*, 92*b* are provided. Squeegee mount knobs 92*a*, 92*b* removably engage deck assembly 66. In some embodiments, squeegee mount knobs 92*a*, 92*b* comprise threaded fasteners. In other embodiments, squeegee mount knobs 92*a*, 92*b* comprise snap-in fasteners or other known quick connect/disconnect fasteners.

FIG. 3 is a rear perspective view of a deck 66 according to one embodiment. The chassis 14 is shown in phantom, such that the drive wheel 31 and associated features are more visible. As shown, the drive wheel 31 is provided in a recess 145 of the chassis such that the drive wheel is bordered by the chassis on three sides. The drive wheel 31 is thus accessible to user from a rear of the device 10 without needing to disassemble the chassis 14. Additionally, the drive wheel 31 and associated components are protected by the chassis on three sides, and increased storage volume for clean or spent fluids or various additional are components is provided. In certain embodiments, the axle 26 of the drive wheel 31 is provided internal to the recess or void space 145 in the chassis 14. As shown in further detail in FIG. 6, the axle 26 and wheel yoke 312 are driven by eccentric hubs 306 of the drive wheel 31, which drive upwardly extending shaft 314 which is interconnected to the pump unit. The positioning of the centrally located drive wheel 31 and surrounding components and position of the chassis 14 provide for a compact unit with a lower center of gravity than known devices, while also providing for additional storage volume (s). The placement of the drive wheel 31 is one aspect of the invention that enables the device 10 to occupy a minimal amount of space while providing its intended cleaning functions and advantages over the prior art.

As shown, deck 66 is selectively connected to the chassis 14 via trailing arm 142, which may be bolted or similarly secured to the chassis 14 via fasteners. A cut-out or recess 145 is provided in the chassis, allowing user-access to, for example, the drive wheel 31 as well as the connection points and fasteners 143 for attaching and removing the deck 66. A tongue or extension 90 extends from the trailing arm 142. One or more pivot points may be provided in the extension 90 to allow the deck 66 to rotate or swivel.

As shown, a deck 66 is selectively interconnected to a remainder of a floor cleaning device 10. The device 10 comprises an aft extension 90 with slotted recesses for receiving and securing fastening members 92*a*, 92*b* to secure the deck 66 to the aft extension 90. In various embodiments, the deck 66 is pivotally mounted on the extension 90 and/or the extension 90 is pivotally provided on the chassis 14 of the device 10. Thus, in at least some embodiments, the deck 66 is at least one of removable from a remainder of the device 10 and rotatable to a position wherein the deck 66 is not in contact with a floor or ground surface.

A dispensing outlet (not shown) is located at a low point of the solution tank 18—preferably at the lowest point of gravitational potential energy of the solution tank 18. The dispensing outlet is detachably connected and in fluid communication with solution inlet plumbing 34. Cleaning solution in the solution distribution trough 18 is released directly onto the floor in some embodiments, or onto a floor pad 62 of deck assembly 66 in other embodiments, including the one shown in FIG. 4. Floor pad 62 is preferably an abrasive pad or brush. In certain embodiments, cleaning solution is not pumped out of solution tank 18, but rather flows out of solution tank 18 due to gravity. In some embodiments, a dispensing valve located in the dispensing outlet or elsewhere in the cleaning solution flow path is used to start and stop the flow of cleaning solution out of solution tank 18.

Figure 4:
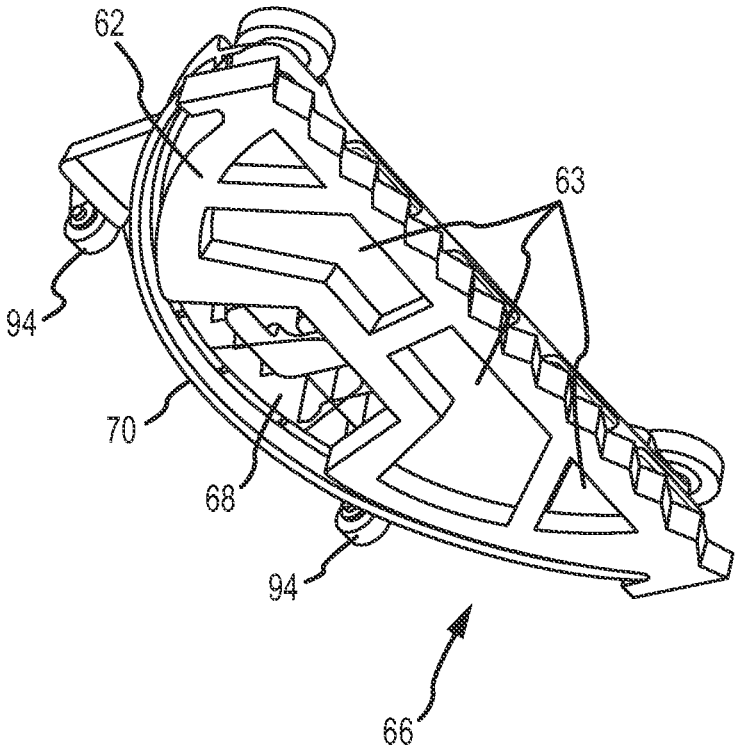
FIG. 4 is a bottom perspective view of a feature of an embodiment of a floor cleaning tool according to the present disclosure.

FIG. 4 is a bottom perspective view of a deck 66 according to one embodiment of the present invention. The deck 66, which may be provided in combination with various embodiments and features provided herein, comprises a debris pad 62. A squeegee 70 is provided on a lower portion of the deck 66, the squeegee comprises a trailing portion to clear any debris and/or water not picked up by additional system components. One or more quick release latches are provided for ease of removal and application of squeegee blade 70. In certain embodiments, one or more articulating debris pads are provided, the articulating debris pads being provided for additional cleaning. In the depicted embodiments, a single debris pad 62 is provided, the debris pad comprising various sections forming a lattice-type structure with one or more void spaces 63 provided therein. A pickup valve assembly 68 comprising a pick-up orifice is provided on a lower portion of the deck 66 and proximal a rear portion thereof. In various embodiments, the assembly 68 is provided sufficiently proximate to a ground surface such that the pump force is capable of removing fluid(s) from the ground surface through, for example, a vacuum force applied by a pump. One or more check valves, as previously described, may be provided in combination with the assembly 68 to prevent back-flow of fluid, particularly when the device 10 is brought to rest and/or the pump is not active.

Embodiments of the present invention contemplate an assembly 68 comprising an aperture provided with a filter or similar device to enable fluid transport through the aperture to prevent large-scale particles and debris from becoming drawn into the device. In various embodiments, the assembly 68 is provided such that the planar area of the orifice is substantially parallel to a floor or ground surface being cleaned. The planar entrance area of the orifice is provided between approximately 0.01 inches and 4.00 inches above a ground surface. Preferably, the planar entrance area of the orifice is provided between approximately 0.05 and 0.075 inches above a ground surface.

Referring now to FIG. 4, deck assembly 66 is supported on a pair of wheels 94 which, in some embodiments, may be raised or lowered by a lift mechanism of one of several types well known in the art. The deck assembly 66 supports squeegee blade 70, which contacts the floor or surface being cleaned. In some embodiments, two or more squeegee blades may be attached to deck assembly 66. Pickup valve assembly 68 is positioned in the center and towards the rear of deck assembly 66, and comprises an orifice as a fluid pickup point located adjacent the floor immediately in front of squeegee blade 70. In embodiments having two or more squeegee blades attached to deck assembly 66, the recovery pickup point may be located between two squeegee blades for improved suction.

In certain embodiments, the deck assembly 66 comprises quick-connect features for one or more pads 62. Pads 62 of the present invention comprise, for example, commercially available 3M® Easy Trap Duster pads, for securing to a lower region of the deck assembly 66. Quick connect features provided on the lower surface of the deck assembly 66 include, but are not limited to, hook and loop pads, clips, and various fasteners useful for securing a cleaning pad 62 to the assembly 66.

FIG. 5 is a perspective view of a floor cleaning device 10 of one embodiment of the present invention. As shown, the device 10 comprises control means 2, such as a handle, in operable communications with a chassis 14. The chassis 14 is provided on wheels 30*a*, 30*b*. A recovery deck 66 is provided as a trailing member and in fluid communication with a pump drive assembly internal to the device 10. A recovery bucket 28 comprises a basin to collect and store dirty liquids recovered from a floor or surface by the pump. The recovery bucket 28 comprises a removable feature such that it may be manually lifted and removed from the chassis 14 for emptying, cleaning, replacement, etc. In certain embodiments, the recovery bucket 28 comprises mop tray or wringer 74. The mop wringer 74 is provided for use with a mop 76, which is selectively securable to the chassis 14 in the embodiment of FIG. 5. Mops and similar devices are contemplated fur use in cleaning operations, and may be particularly useful for cleaning surface and locations that the device 10 may not be able to access (e.g. corners and areas underneath certain objects). The upper portion of the recovery bucket 28 comprises tray and/or wringer features for receiving a mop head and further allowing contents to drain into the recovery bucket 28. In the depicted embodiment, the recovery bucket 28 is provided in a central void 70 of the chassis 14. Various embodiments of the present invention contemplate providing such a chassis 14 with an interior portion 70 that is void or partially void so as to accommodate various devices and features, including recovery bucket 28 and/or storage unit 12 (see FIG. 1).

As shown, the device 10 is capable of receiving a known or preexisting mop device 72 on a chassis 14. The device 72 comprises receiving means, such as indentations, troughs, clips, etc. for receiving a mop. Such features are provided in addition to or in lieu of fluid dispensing means shown and described herein. In one embodiment, a mop is provided for additional cleaning functionality and is useful in, for example, situations where the device 10 may have missed portions of a floor to be cleaned and spot cleaning with the mop is desirable. Additionally, a wringer or mop tray 72 is provided for supplying the mop with fluid and/or cleaning the mop after and during use.

As shown in FIG. 5, a feature of the present invention comprises a novel attachment member 100. Attachment member 100 is capable of at least two modes of use. A first mode is provided wherein a cylindrical portion of the attachment member is disposed in a recess and a hook portion extends outwardly therefrom. In this first mode, various features such as a "wet floor" sign 78 may be hung from the attachment member 100. In a second mode, the attachment member 100 is attached to an additional device, such as mop 76. The cylindrical portion of the attachment member 100 comprises a removable clip that can be selectively secured to various features, such as the elongate shaft of a mop 76. Once secured, the hook portion extends outwardly therefrom and may be placed or inserted into the chassis 14, such that the mop 76 is supported thereon. It will be recognized, therefore, that the attachment member 100 comprises a single device that is capable of two different modes of use for storage and/or transport of articles.

Figure 6:
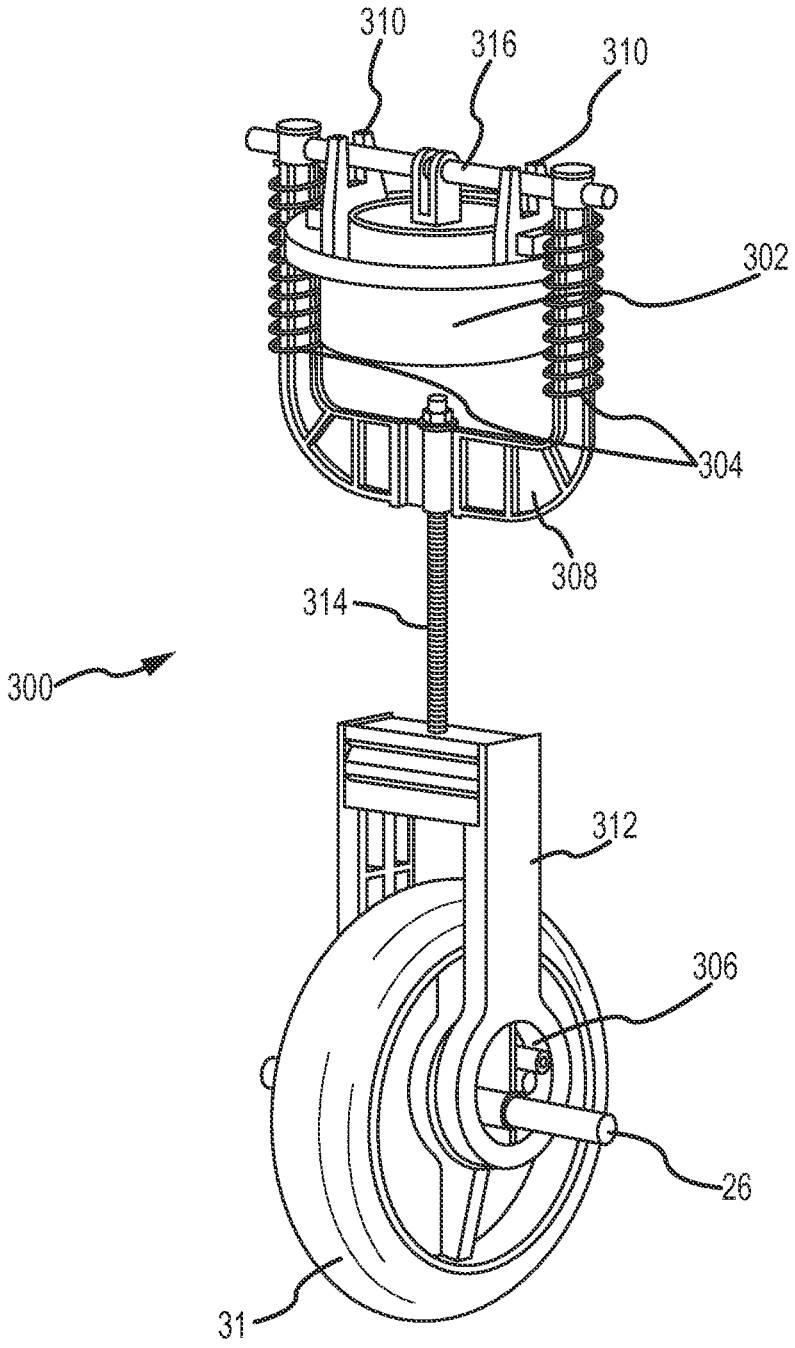
FIG. 6 is a perspective view of a component of one embodiment of the present invention.

Referring now to FIG. 6, a mechanically driven pump 300 according to one embodiment is provided in fluid communication with the recovery tank (not shown). In the depicted embodiment, the pump 300 is a diaphragm pump, but in other embodiments other types of pumps, such as piston pumps or centrifugal pumps, are provided. A pump housing 302 is provided, the pump within the housing 302 being driven by a drive wheel 31 provided in rolling contact with a floor surface. The drive wheel 31 comprises eccentric wheel hubs 306 with an axle 26 supported on a frame or chassis. The hubs 306 are connected to a wheel yoke 312, which is connected to a pump yoke 308 via a shaft 314. The pump is actuated by movement of the wheel 31 and associated eccentric hubs 306, which induces a reciprocating vertical movement of a cross-bar 316 which provides power to the pump. Vertical movement of the guide bar 316 is assisted by vertical guide slots 310 extending upwardly from the pump housing 302. One or more coil springs 304 are provided on the pump yoke 308 to bias the pump and associated components.

Floor cleaning tools of the present invention are primarily intended to deliver and collect a controlled volume of cleaning solution from the floor during normal floor cleaning operations, and persons of ordinary skill in the art will appreciate that pumps and recovery tanks should be sized appropriately. However, other uses of floor cleaning tools will be readily apparent to persons of skill in the art. For example, floor cleaning tools of the present invention may be used to collect puddles and spills. To ensure that floor cleaning tools are useful for such applications, pumps and recovery tanks preferably have excess capacity, so that they can collect a greater volume of liquid, at a higher rate, than is required for normal floor cleaning operations.

In some embodiments, a cleaning solution tank is positioned above the pump and/or recovery tank, thereby raising the lowest point of the solution tank and enhancing the gravity-powered flow of cleaning solution from the cleaning solution tank. Other arrangements are possible. For example, in some embodiments, cleaning solution tank and recovery tank occupy horizontally adjacent positions; i.e., cleaning solution tank may be located forward of recovery tank on chassis, or cleaning solution tank may be located to one side of recovery tank on chassis. This facilitates access to both tanks, and reduces the overall height of floor cleaning tool. Removal of tanks for replacement, cleaning, emptying, and/or refilling are also simplified in such embodiments.

In various embodiments of the present invention, the sizes of cleaning solution tank, recovery tank, pump, and squeegee are selected based on the target market for the floor cleaning tool. For example, floor cleaning tools intended to be used commercially preferably comprise larger components than floor cleaning tools intended for household use, as commercial applications are likely to have significantly greater surface area to clean.

While various embodiments of the present disclosure have been described in detail, it is apparent that modifications and alterations of those embodiments will occur to those skilled in the art. However, it is to be expressly understood that such modifications and alterations are within the scope and spirit of the present disclosure, as set forth in the following claims. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as additional items.

What is claimed is:

1. A portable, human-powered floor cleaning device comprising:

a chassis comprising a clean fluid storage tank and a spent fluid collection tank;

a plurality of wheels for supporting and moving the device;

a deck assembly comprising a fluid pick-up orifice and a squeegee;

a mechanically-driven pump housed within the chassis having an inlet and an outlet, the pump operably interconnected to a drive wheel;

the drive wheel provided substantially proximal to a midpoint of the chassis and comprising an eccentric wheel hub interconnected to a drive shaft such that a rotational movement of the drive wheel results in a reciprocating movement of the shaft and actuation of the pump;

the fluid pick-up orifice being interconnected to the pump by a conduit for transmitting a spent fluid from the fluid pick-up orifice to the pump;

a mop comprising a handle; and at least one attachment member, the at least one attachment member secured at a first end to the chassis, and at a second end attachable to the mop, securing the mop to the device, wherein the mop can be detached from the at least one attachment member to clean portions of the floor not reachable by the device.

2. The device of claim 1, wherein the first end of the at least one attachment member further comprises:

a hook portion inserted into a recess in the chassis.

3. The device of claim 2, wherein the second end of the at least one attachment member further comprises:

a cylindrical portion having a removable clip that can be selectively secured to a shaft of the mop.

4. The device of claim 3, further comprising:

a shelf on the lower portion of the chassis for receiving an end of the mop when the mop is secured to the device.

5. The device of claim 4, further comprising:

a sign hung from the at least one attachment member, wherein the cylindrical portion of the at least one attachment member is inserted into the recess in the chassis, and the hook portion extends outwardly to engage with a top portion of the sign, wherein the shelf supports a lower portion of the sign.

6. The device of claim 1, further comprising:

a mop device received in a center portion of the chassis, the mop device having a wringer; and a recovery bucket located under the mop device in the chassis, wherein a fluid extracted by the wringer from the head of the mop drains into the recovery bucket, wherein the recovery bucket is removable from the chassis to dispose of the fluid collected.

7. A motorless floor washing machine comprising:

a chassis comprising a clean fluid storage tank and a spent fluid collection tank;

at least two wheels for supporting and moving the machine;

a trailing deck assembly comprising a fluid pick-up orifice and a squeegee;

a mechanically-driven pump housed within the chassis having an inlet and an outlet, the pump operably interconnected to a drive wheel, the drive wheel provided substantially proximal to a midpoint of the chassis and comprising an eccentric wheel hub interconnected to a drive shaft such that a rotational movement of the drive wheel results in a reciprocating movement of the shaft and provides power to the pump;

the fluid pick-up orifice being interconnected to the pump by a conduit for transmitting fluid from the fluid pick-up orifice to the pump;

a mop comprising a handle; and at least one attachment member, the at least one attachment member secured at a first end to the chassis, and at a second end attachable to the mop, securing the mop to the machine, wherein the mop can be detached from the at least one attachment member to clean portions of the floor not reachable by the machine.

8. The motorless floor washing machine of claim 7, wherein the first end of the at least one attachment member further comprises:

a hook portion inserted into a recess in the chassis.

9. The motorless floor washing machine of claim 8, wherein the second end of the at least one attachment member further comprises:

a cylindrical portion having a removable clip that can be selectively secured to a shaft of the mop.

10. The motorless floor washing machine of claim 9, further comprising:

a shelf on the lower portion of the chassis for receiving an end of the mop when the mop is secured to the machine.

11. The motorless floor washing machine of claim 10, further comprising:

a sign hung from the at least one attachment member, wherein the cylindrical portion of the at least one attachment member is inserted into the recess in the chassis, and the hook portion extends outwardly to engage with a top portion of the sign, wherein the shelf supports a lower portion of the sign.

12. The motorless floor washing machine of claim 7, further comprising:

a mop device received in a center portion of the chassis, the mop device having a wringer; and a recovery bucket located under the mop device in the chassis, wherein a fluid extracted by the wringer from the head of the mop drains into the recovery bucket, wherein the recovery bucket is removable from the chassis to dispose of the fluid collected.

13. A floor cleaning tool for cleaning a surface, comprising:

a chassis comprising:

a first tank for containing a cleaning solution, the first tank having a discharge port positioned to effect dispensing of the cleaning liquid therefrom;

a second tank for receiving the cleaning solution following its being dispensed to the surface; and a mechanically-driven pump for removing the cleaning solution from the surface and discharging the collected cleaning solution into the second tank;

a rotatable trailing deck assembly comprising a squeegee, the deck assembly being selectively detachable from the chassis;

a main wheel assembly comprising at least two wheels for supporting and moving the chassis;

at least one of the wheels comprising a drive wheel with a rotational motion mechanism for converting the rotational motion of the drive wheel into reciprocal motion;

the drive wheel provided substantially directly beneath the pump and operably connected to the pump by a drive shaft;

a mop comprising a handle; and at least one attachment member, the at least one attachment member secured at a first end to the chassis, and at a second end attachable to the mop, securing the mop to the tool, wherein the mop can be detached from the at least one attachment member to clean portions of the floor not reachable by the tool.

14. The floor cleaning tool of claim 13, wherein the first end of the at least one attachment member further comprises:

a hook portion inserted into a recess in the chassis.

15. The floor cleaning tool of claim 14, wherein the second end of the at least one attachment member further comprises:

a cylindrical portion having a removable clip that can be selectively secured to a shaft of the mop.

16. The floor cleaning tool of claim 15, further comprising:

a shelf on the lower portion of the chassis for receiving an end of the mop when the mop is secured to the tool.

17. The floor cleaning tool of claim 16, further comprising:

a sign hung from the at least one attachment member, wherein the cylindrical portion of the at least one attachment member is inserted into the recess in the chassis, and the hook portion extends outwardly to engage with a top portion of the sign, wherein the shelf supports a lower portion of the sign.

18. The floor cleaning tool of claim 13, further comprising:

a mop device received in a center portion of the chassis, the mop device having a wringer; and a recovery bucket located under the mop device in the chassis, wherein a fluid extracted by the wringer from the head of the mop drains into the recovery bucket, wherein the recovery bucket is removable from the chassis to dispose of the fluid collected.

* * * * *